US005406988A

United States Patent [19]

Hopkins

[11] Patent Number: 5,406,988

[45] Date of Patent: Apr. 18, 1995

[54] METHOD AND APPARATUS FOR DISPENSING COMPRESSED GAS INTO A VEHICLE

[75] Inventor: Pat F. Hopkins, Danville, Calif.

[73] Assignee: Pacific Cryogenics, Inc., Oakland, Calif.

[21] Appl. No.: 160,091

[22] Filed: Dec. 1, 1993

[51] Int. Cl.[6] ..... B65B 1/04; B65B 3/04

[52] U.S. Cl. ..... 141/2; 141/4; 141/18; 141/47; 141/54; 141/102; 141/197; 123/527

[58] Field of Search ..... 141/2, 3, 4, 18, 37, 141/39, 47, 54, 99, 100, 102, 104, 197; 222/1, 64, 66, 3, 145, 639; 137/256, 571; 123/525, 527

[56] References Cited

U.S. PATENT DOCUMENTS

| | | | |
|---|---|---|---|
| 3,719,196 | 3/1973 | McJones | 137/256 |
| 3,886,982 | 6/1975 | Uth et al. | 141/39 |
| 4,531,558 | 7/1985 | Engel et al. | 123/525 |
| 5,107,906 | 4/1992 | Swenson et al. | 141/11 |
| 5,253,682 | 10/1993 | Haskett et al. | 141/3 |

OTHER PUBLICATIONS

"Technology Gap Analysis of CNG Refueling Systems" Final Report, R. F. Webb and B. C. Gas International, Inc., for Gas Research Institute, Sep. 1991.

*Primary Examiner*—Henry J. Recla
*Assistant Examiner*—Steven O. Douglas
*Attorney, Agent, or Firm*—Fliesler, Dubb, Meyer & Lovejoy

[57] ABSTRACT

A method and apparatus for dispensing compressed gas from n storage vessels containing compressed gas. Gas is sequentially dispensed from each of the storage vessels until predetermined delivery conditions are reached for each storage vessel. After the predetermined delivery conditions are reached in storage vessel n, storage vessel n is backfilled using the remaining compressed gas from the other storage vessels. The backfilling provides greater extraction of stored gas in the storage vessels and consistently fast fill times.

20 Claims, 9 Drawing Sheets

METHOD AND APPARATUS FOR DISPENSING COMPRESSED GAS INTO A VEHICLE

BACKGROUND OF THE INVENTION

1. Field of the Invention

The present invention generally relates to a method and apparatus for dispensing compressed gas from a storage facility to a vehicle. More particularly, the present invention relates to an improved method and apparatus for dispensing substantially greater amounts of compressed gas from a storage vessel. By dispensing greater amounts of stored gas, the improved method and apparatus reduces the need to repeatedly refill the storage vessel and thereby minimizes transportation costs associated with refilling.

2. Description of the Related Art

A variety of compressed natural gas (CNG) fueling stations have been proposed to dispense CNG into natural gas vehicles (NGVs). CNG fueling stations must provide cost efficient and convenient dispensing of CNG to overcome customer concerns that may hinder public acceptance of NGVs.

Several conventional fueling stations are described in a Gas Research Institute publication entitled "Technology Gap Analysis of CNG Refueling Systems, Final Report" (GRI-91/0371), September 1991.

A first conventional fueling station 9 is schematically illustrated in FIG. 1. Station 9 includes a dispenser 10, a priority panel 80, a compressor 70, a fueling nozzle 20, and three immobile CNG storage banks: low bank 30, medium bank 40, and high bank 60. Station 9 dispenses CNG to a NGV 50 in the following manner. First, CNG is transferred to NGV 50 from low bank 30. As the pressure of CNG of low bank 30 decreases and the pressure of CNG in NGV 50 increases, the flow rate decreases. At a predetermined minimum flow rate, the dispenser 10 switches to the medium bank 40 to utilize the CNG in medium bank 40. Similarly, the NGV 50 will be filled from the medium bank 40 until a predetermined flow rate is reached, at which point CNG is supplied from the high bank 60 to complete the fill. When the pressure of CNG in the low bank 30 or high bank 60 drops, a compressor 70 is used to refill storage banks 30, 40 and 60 to the desired pressures using the priority panel 80.

In conventional fueling station 9, storage banks 30, 40 and 60 typically require high capital costs associated with their installation and maintenance. Furthermore, dispensing limitations exist when the dispensing system switches between the different banks based on a minimum flow rate. If the minimum flow rate is set at a low value, there is greater extraction of stored CNG but slower fill rates. Conversely, if the minimum flow rate is set at a high value, there is less extraction of stored CNG and faster fill rates. Consequently, a compromise must be made between gas extraction and fill rates with the result that neither good extraction of stored CNG nor fast fill rates are achieved.

A second conventional fueling station 100 which includes a pressure booster 140 is illustrated in FIG. 2. NGV 50 is filled initially from a single storage bank 130 and the fill is completed by the pressure booster 140 to the required NGV pressure by drawing down CNG from storage bank 130 through the dispenser 160. A compressor 150 is used to refill the storage bank 130. Improved extraction of CNG and faster fill times are achieved through the use of a pressure booster. In addition, installation and maintenance costs may be lowered by dispensing the CNG from mobile tube trailer storage instead of immobile storage.

Although the pressure booster configuration improves extraction of stored CNG, the booster configuration is only able to extract approximately 58% of stored CNG at low pressure CNG storage. This is an economically inefficient use of stored CNG. In addition, there are increased transportation costs due to the low amount of gas extracted from storage since the trailer must be refueled frequently.

SUMMARY OF THE INVENTION

It is, therefore, an object of the present invention to provide an improved method and apparatus for removing greater amounts of stored CNG from a tube trailer and thereby minimize refueling transportation costs.

A further object of the present invention is to provide an improved method and apparatus for providing consistently fast NGV fill times.

Another object of the present invention is to provide an improved method and apparatus for dispensing CNG that does not require high capital and maintenance costs.

These and other objects of the present invention are provided by a method and apparatus for dispensing compressed gas from n storage vessels containing compressed gas. Gas is sequentially dispensed from each of the storage vessels until predetermined delivery conditions are reached for each storage vessel. After the predetermined delivery conditions are reached in storage vessel n, storage vessel n is backfilled using the remaining compressed gas from the other storage vessels. The backfilling provides greater extraction of stored gas in the storage vessels and consistently fast NGV fill times.

A method of transferring compressed gas from a group of storage vessels to a NGV, in accordance with the present invention, includes the steps of sequentially dispensing gas from each of n storage vessels until predetermined delivery conditions are reached for each storage vessel. When storage vessel n begins dispensing, a booster pump is activated to increase the pressure of the gas dispensed from storage vessel n in order to reach a predetermined container pressure. When the pressure is reached, dispensing ends and a new NGV is attached to the dispensing system and the sequencing begins again. After several fill cycles, when the pressure of the gas in storage vessel n reaches a predetermined pressure, the gas from the storage vessels 1 to n−1 are used to backfill storage vessel n.

An apparatus in accordance with the present invention includes a group of storage vessels, a booster pump, a manifold system to connect the storage vessels to one another, to the booster pump, and to the manifold outlet, and a control system to operate the manifold system.

DESCRIPTION OF THE PREFERRED EMBODIMENTS

The preferred embodiments of a method and apparatus for dispensing compressed natural gas in accordance with the present invention will be described with reference to FIGS. 3–7D. It is to be understood, however, that the method and apparatus are applicable to dispensing other types of compressed gas.

Figure 1:
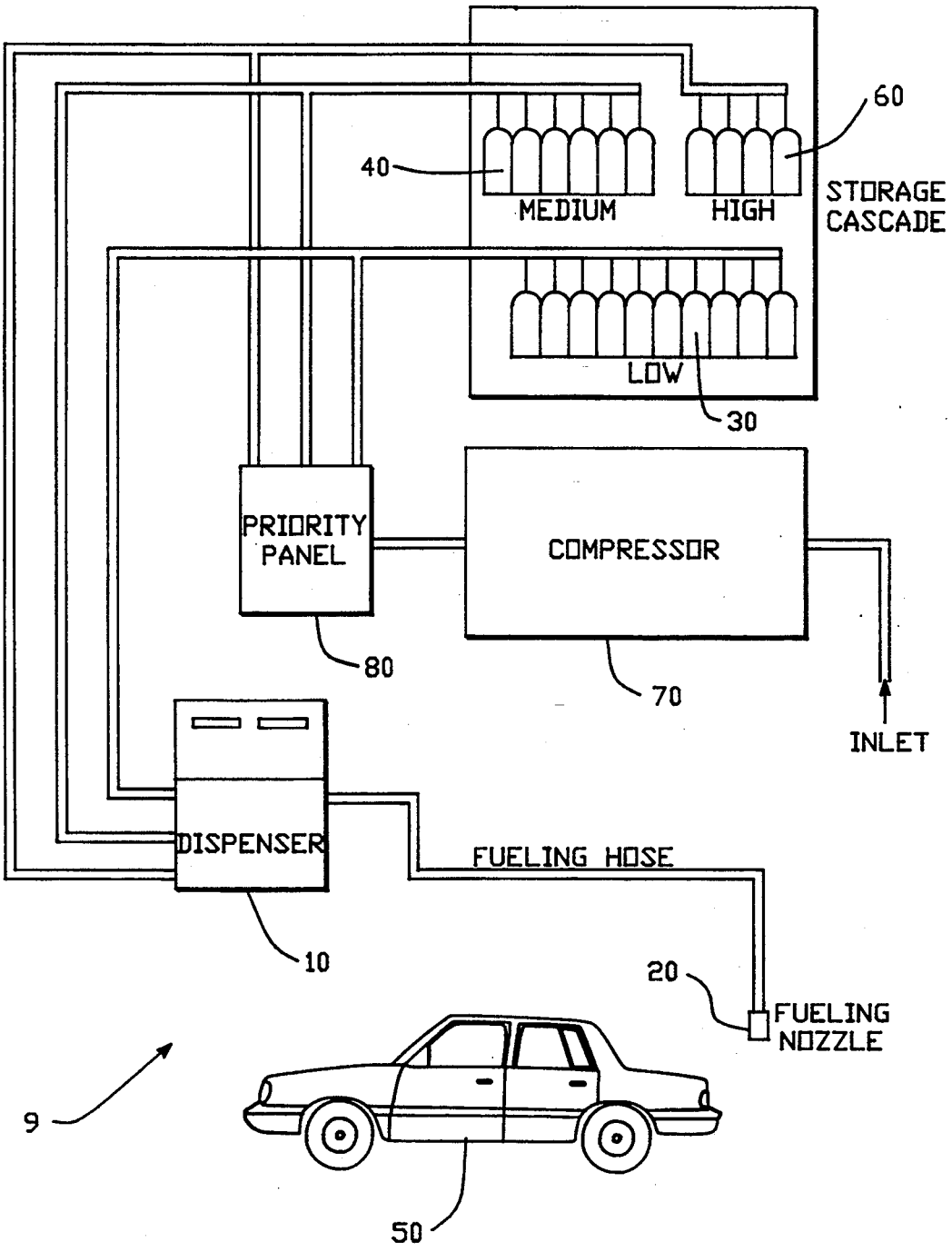
(PRIOR ART) FIG.—1
FIG. 1 is a schematic diagram of a first conventional fueling station.
Figure 2:
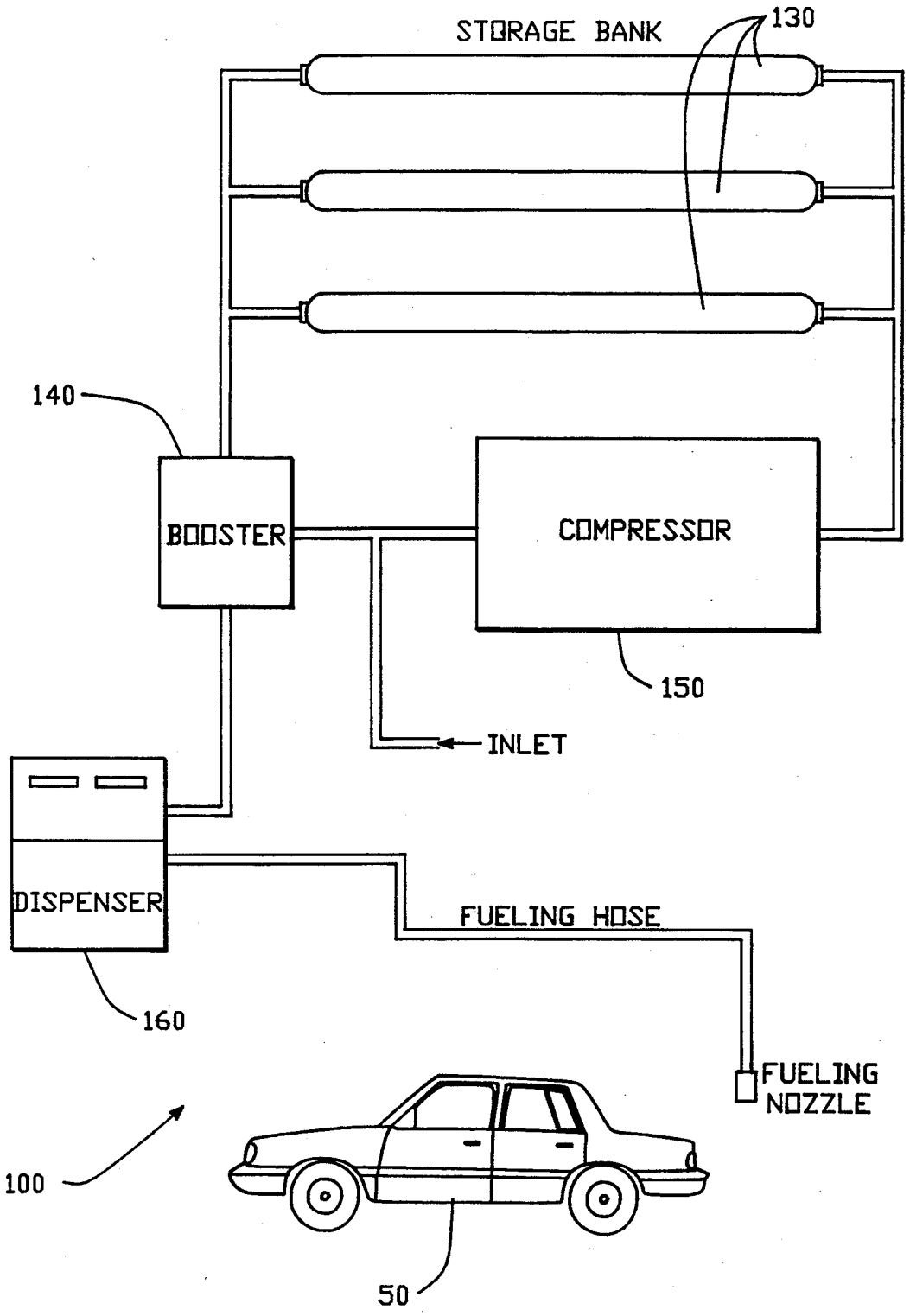
(PRIOR ART) FIG.—2
FIG. 2 is a schematic diagram of a second conventional fueling station.
Figure 3:
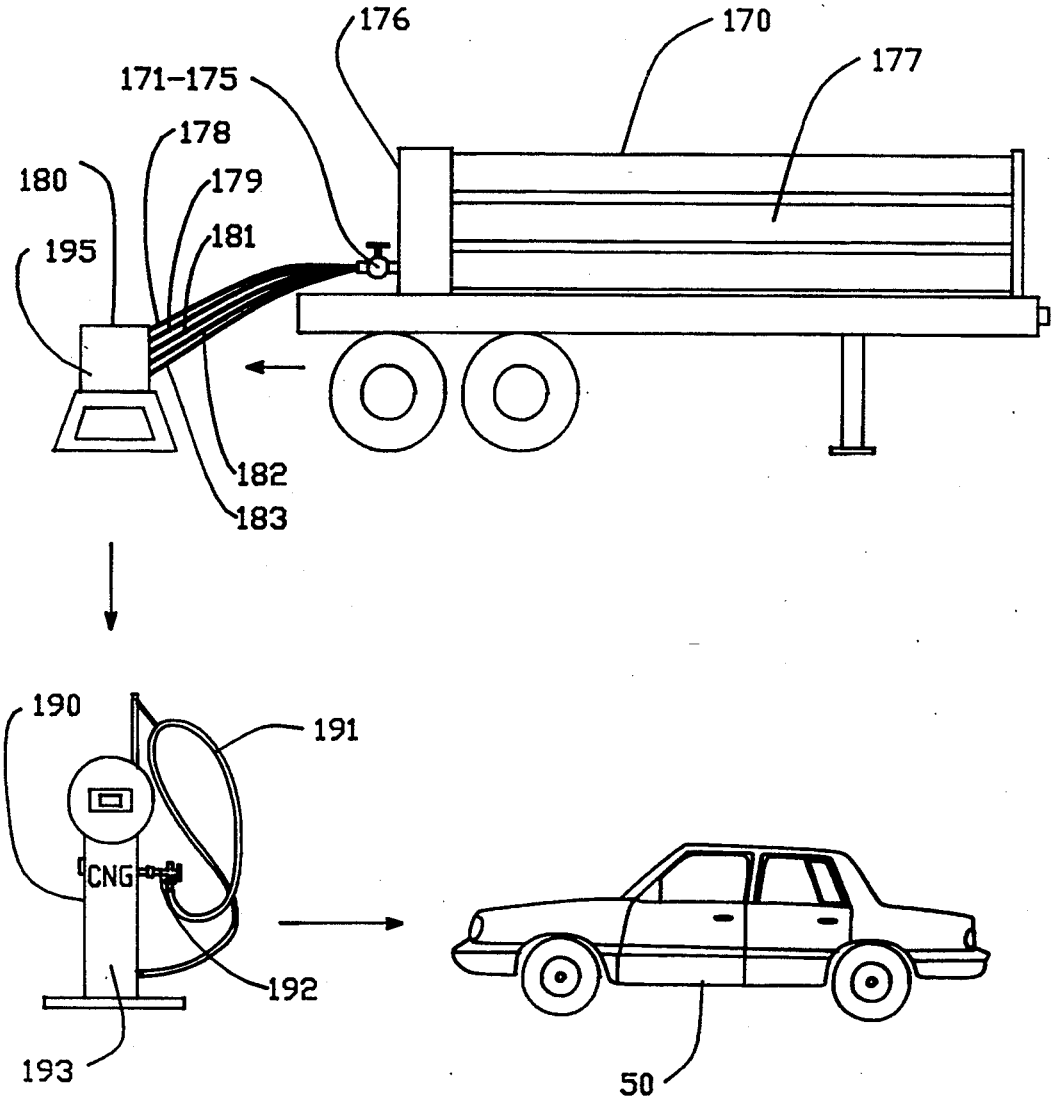
FIG. 3 is a side view of the dispensing system of the present invention.

FIG. 3 is a side view of the dispensing system of the present invention. A mobile tube trailer 170 contains tube trailer cylinders 177 filled with CNG. The tube trailer cylinders 177 release CNG through connecting tubes 176 (generally 38 tubes) that are manifolded into five distinct banks 171–175; each bank 171–175 of connecting tubes 176 is referred to as a storage vessel. It is understood that although the preferred embodiment uses five banks or storage vessels 171–175 and generally 38 connecting tubes 176, other embodiments may use a different number of storage vessels 171–175 and connecting tubes 176. Each of the five storage vessels 171–175 are connected to a control/sequencing panel housing 180 by natural gas hoses 178, 179, 181, 182, 183. In the preferred embodiment, the control/sequencing panel housing 180 is permanently mounted. However, other embodiments may utilize a control/sequencing panel housing that is not permanently mounted.

A control/sequencing panel 195, located within the control/sequencing panel housing 180, controls the transfer (or dispensing) of CNG from the storage vessels 171–175. The control/sequencing panel 195 of the present invention is able to extract approximately 85% of the stored CNG in storage vessels 171–175 which is a significant improvement over conventional fueling stations that achieved only 58% extraction of stored CNG at low pressure storage. Furthermore, the improved extraction of stored gas is achieved with consistently fast NGV fill times. The control/sequencing panel 195 is connected to a NGV 50 through a remote dispenser 190. The remote dispenser 190 is composed of a dispenser stand 193, a hose 191, and a nozzle 192 that are used to fuel a NGV 50.

Figure 4:
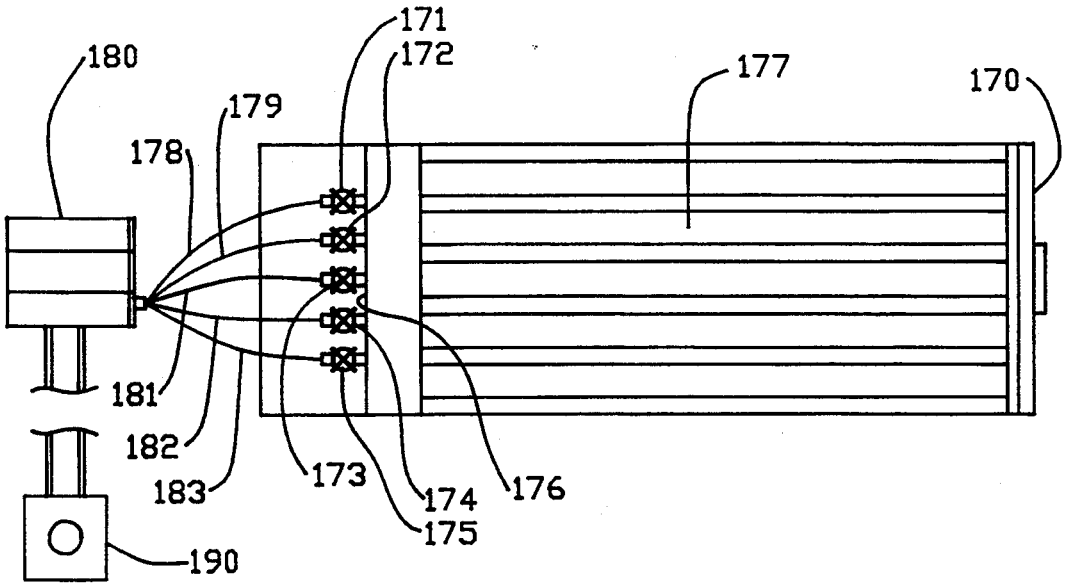
FIG. 4 is a top view of the dispensing system of the present invention.

FIG. 4 is a top view of the dispensing system of the present invention. Five storage vessels 171–175 transfer CNG from the tube trailer cylinders 177 through the connecting tubes 176 and the natural gas hoses 178, 179, 181, 182, 183 into the control/sequencing panel housing 180. The CNG is then transferred to a NGV (not shown) through the remote dispenser 190.

Figure 5:
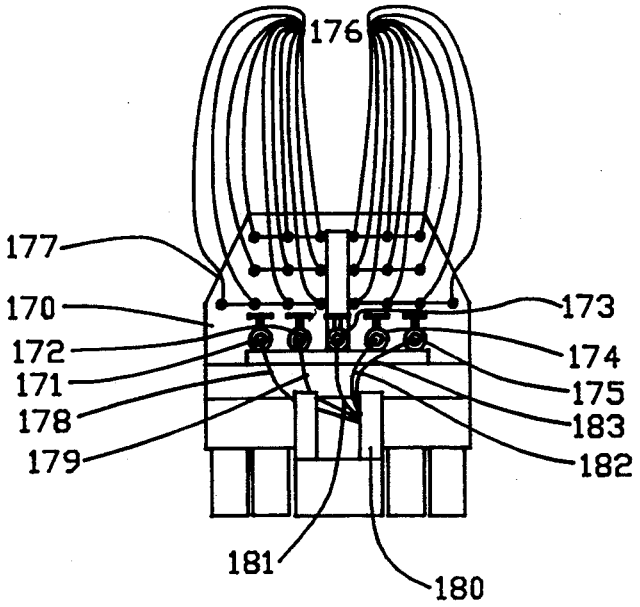
FIG. 5 is a back view of the dispensing system of the present invention.

FIG. 5 is a back view of the overall dispensing system of the present invention. From this view, the connecting tubes 176 transport the CNG from the tube cylinders 177 located on the tube trailer 170 to the five storage vessels 171–175. The five natural gas hoses 178, 179, 181, 182, 183 lead into the control/sequencing panel housing 180.

Figure 6:
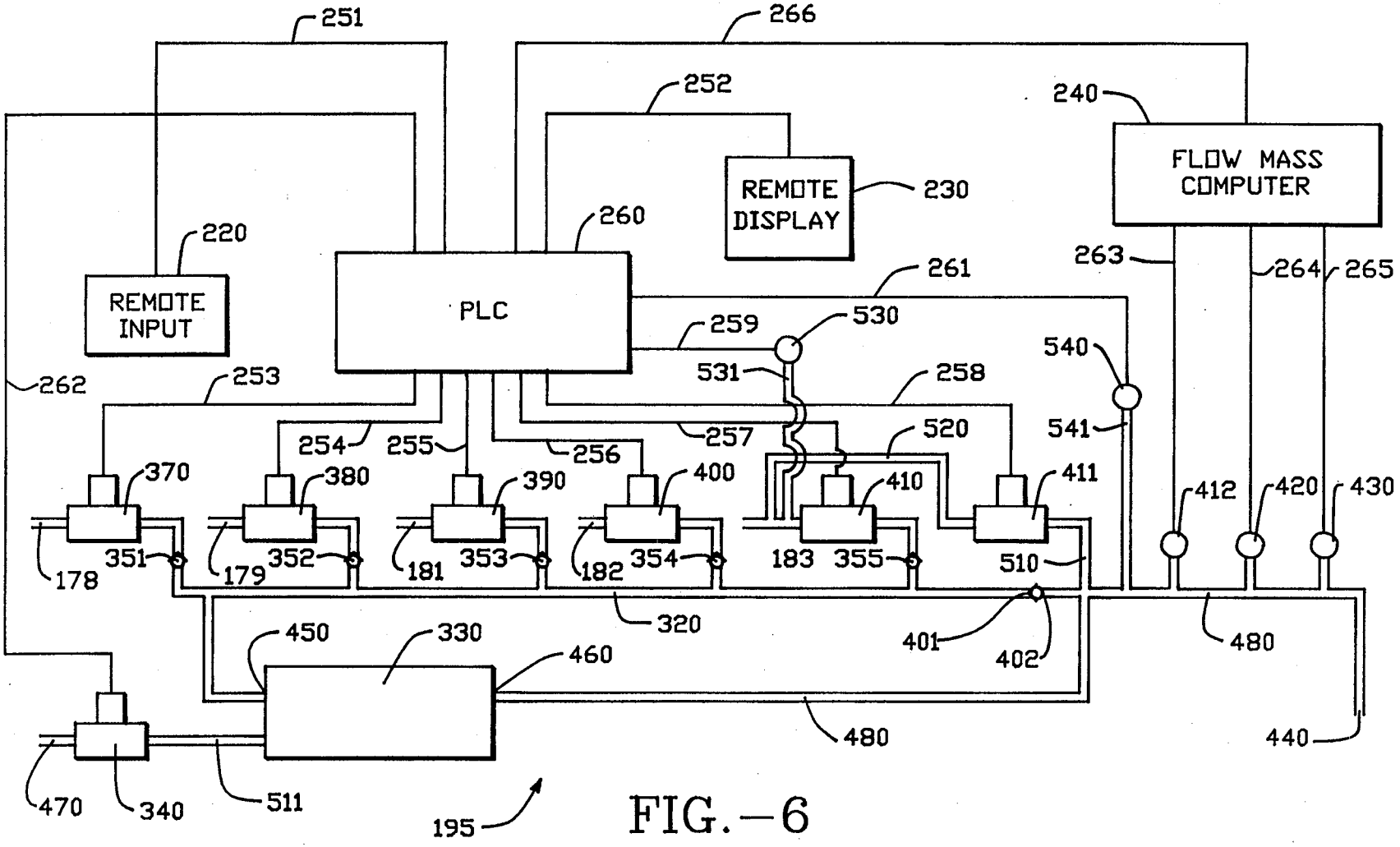
FIG. 6 is a schematic diagram of the control/-sequencing panel of the present invention.
Figure 7A:
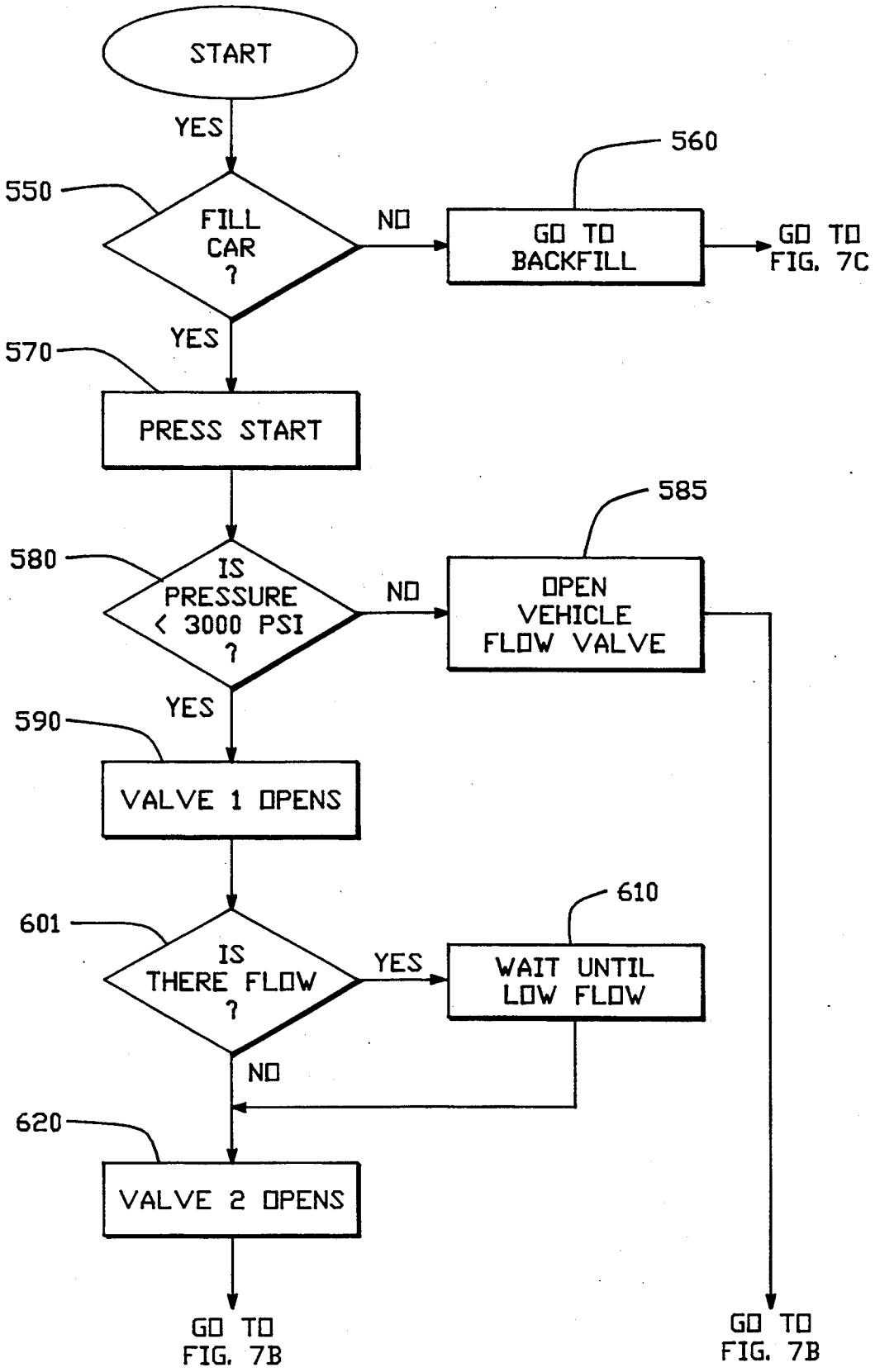
FIGS. 7A–7D are flow charts for a method of dispensing CNG in accordance with the present invention.
Figure 7B:
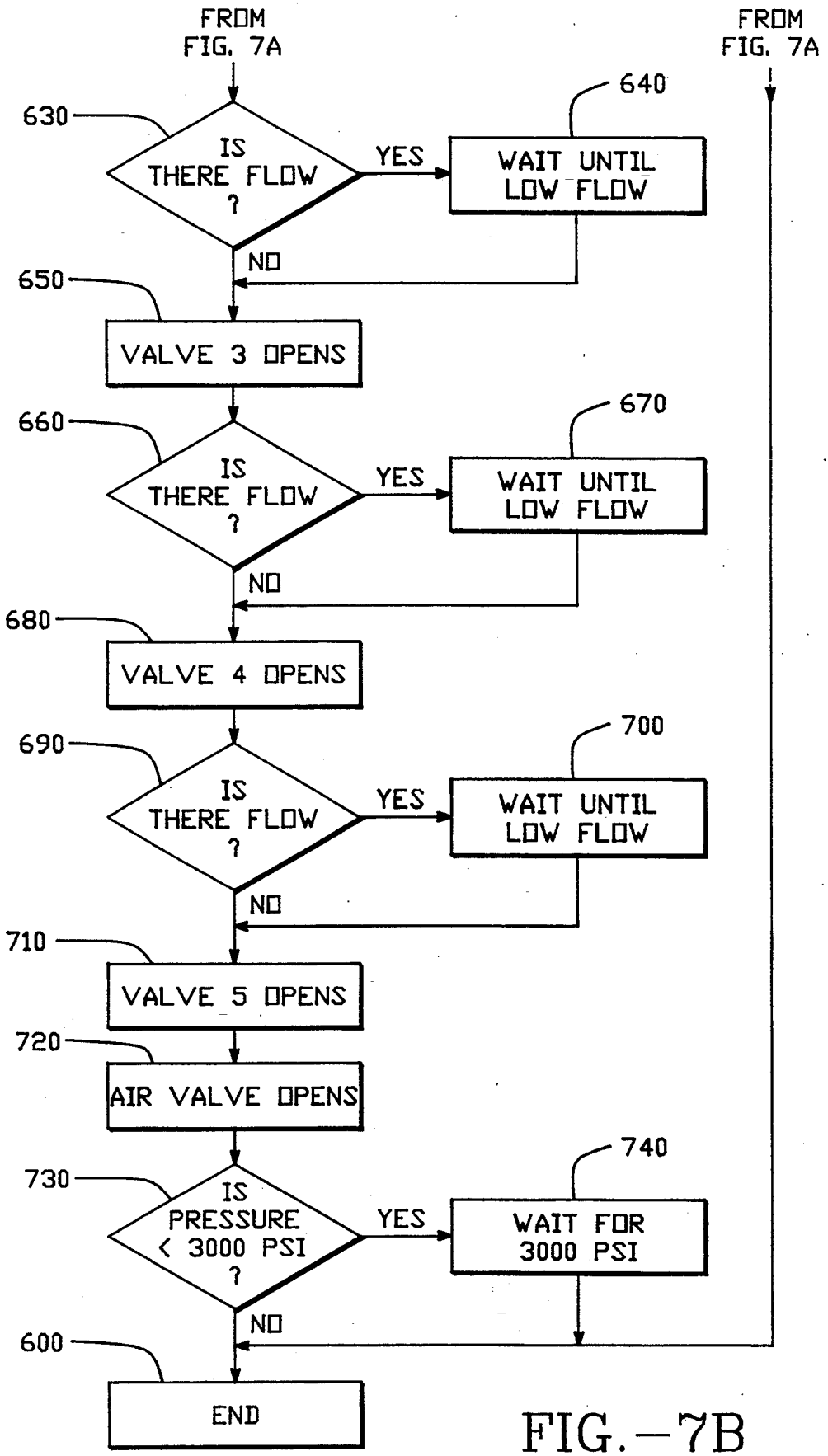
Figure 7C:
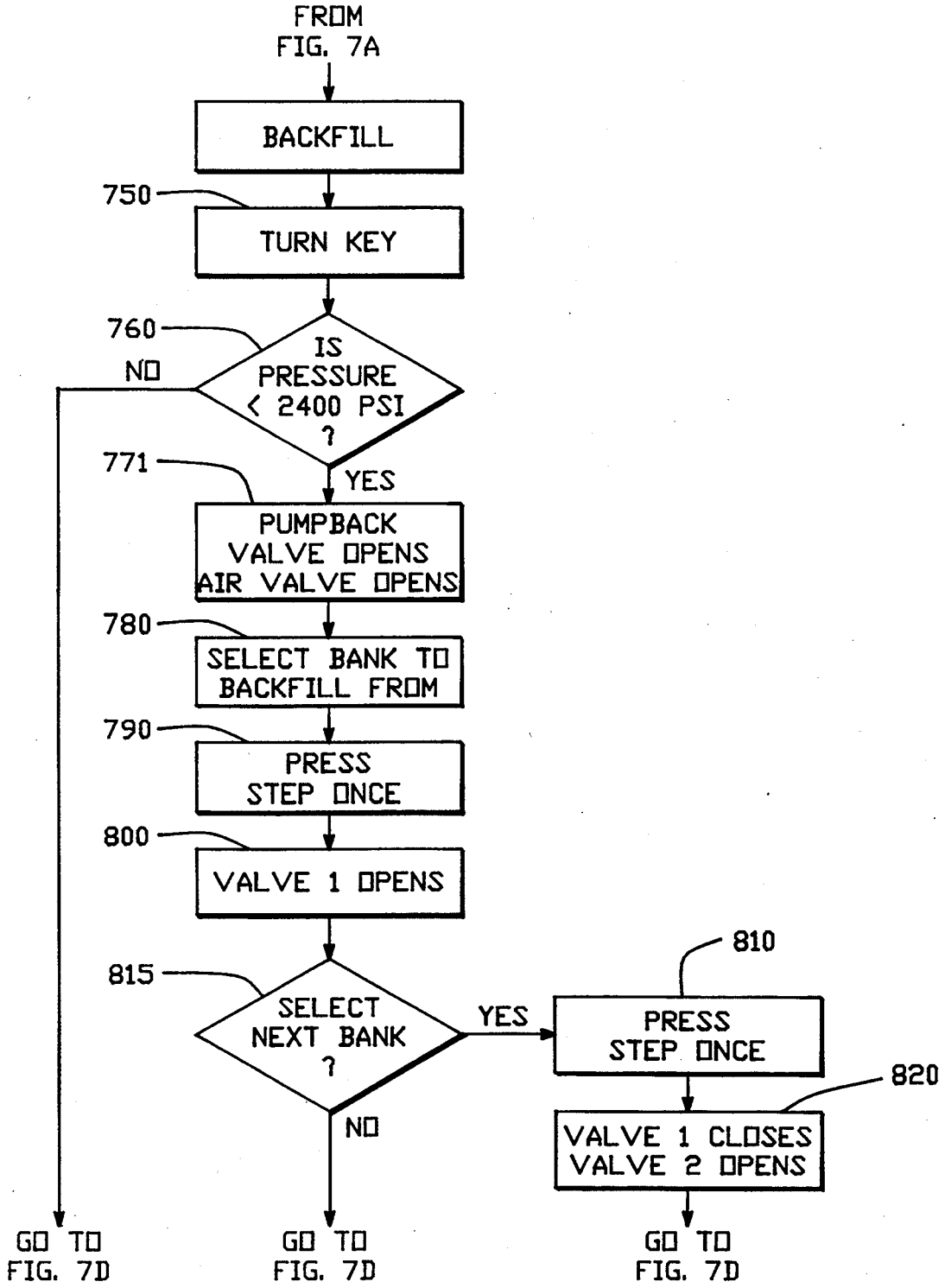
Figure 7D:
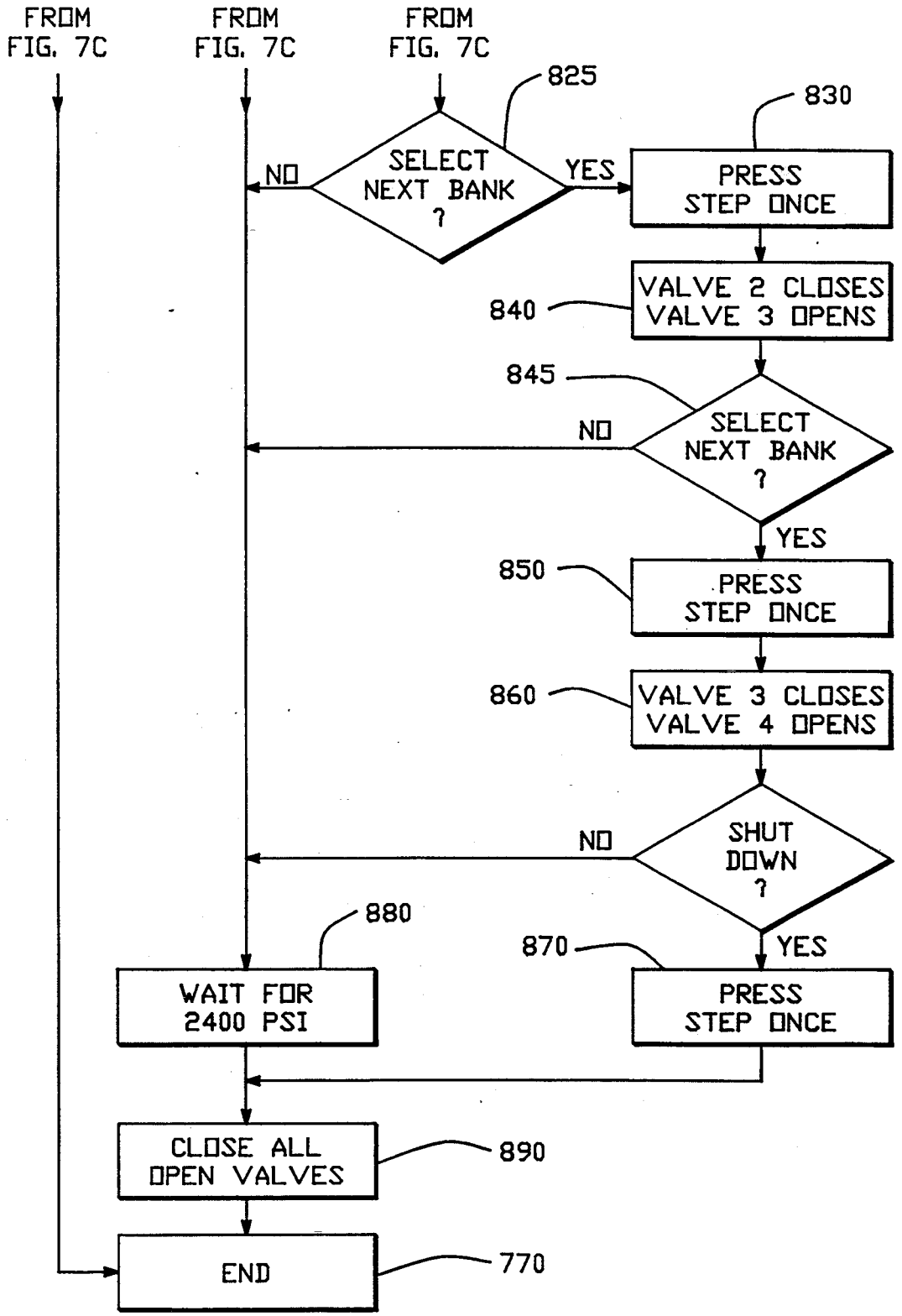

FIG. 6 is a schematic diagram of the control/-sequencing panel 195 of the present invention. A remote input 220 permits a user to manually start and stop the dispensing of CNG into the NGV. In addition, the remote input 220 allows for manual operation of the backfilling procedure of the present invention. The remote input 220 is electronically connected through a remote input line 251 to a programmable logic controller (PLC) 260 which responds to the requested manual input at the remote input 220. A remote display 230 is provided in the remote dispenser 190 to provide system information to the user. The remote display 230 is electronically connected through a remote display line 252 to the PLC 260 to retrieve information for the user.

The PLC 260 controls electronically operated air or gas solenoid valves 370, 380, 390, 400, 410 through valve control lines 253–257. In the preferred embodiment, gas solenoid valves 370, 380, 390, 400, 410 are used although air operated valves that have higher pressure ratings may also be used. Each gas solenoid valve 370, 380, 390, 400, 410 receives CNG through a respective one of natural gas hoses 178, 179, 181, 182, 183. The gas solenoid valves 370, 380, 390, 400, 410 are connected by a first manifold gas line 320 to each other, to a gas booster inlet 450 of a gas booster pump 330, and to a check valve inlet 401. CNG is prevented from flowing back into the gas solenoid valves 370, 380, 390, 400, 410 by control valves 351–355 located on the first manifold gas line 320 near each gas solenoid valve 370, 380, 390, 400, 410.

A second manifold gas line 480 connects a gas booster outlet 460 of the gas booster pump 330, a check valve outlet 402, and a manifold outlet 440 to direct CNG flow. The second manifold gas line 480 is also connected to a backfill solenoid valve 411 by a third manifold gas line 510. The second manifold gas line 480 connects the gas booster outlet 460 to the third manifold gas line 510 in order to send CNG to the backfill solenoid valve 411. The backfill solenoid valve 411 is electronically connected to the PLC 260 by a backfill valve control line 258. The CNG received by the backfill solenoid valve 411 is transported through a backfill valve gas line 520 to the fifth gas solenoid valve 410. A natural gas hose pressure sensor 530 is connected by a hose sensor gas line 531 to natural gas hose 183 in order to determine the gas pressure within the fifth storage vessel 195. The natural gas hose pressure sensor 530 is also electronically connected through hose sensor line 259 to PLC 260 to transmit pressure information to the PLC 260. In addition, a second manifold pressure sensor 540 is connected to the second manifold gas line 480 through manifold sensor gas line 541 and also electronically connected to PLC 260 to transmit pressure information to the PLC through a manifold sensor control line 261.

Gas booster pump 330 is also connected to an air line 511 which carries air to the gas booster pump 330 from a booster solenoid valve 340. There are no restrictions on the type of booster pump that may be used, but in the preferred embodiment, an air driven gas booster pump is employed. The booster solenoid valve 340 is electronically connected by a booster valve control line 262 to the PLC 260 where the operation of the booster solenoid valve 340 is controlled. The booster solenoid valve 340 receives the air that is used to drive the gas booster pump 330 from booster valve air line 470.

Connected to the second manifold gas line 480 are flow 412, temperature 420 and pressure 430 meters which are electronically connected to a flow mass computer 240 by meter lines 263–265 to transmit information to the flow mass computer 240. The flow mass computer 240 then electronically transmits the information through flow line 266 to the PLC 260. The second manifold gas line 480 is also connected to a manifold outlet 440 which transports the CNG to a NGV.

FIGS. 7A–7D are flow charts of the method of operation of the present invention. The preferred method of operation of the control/sequencing panel 195 will be described with reference to FIGS. 7A–7D. It is understood that one skilled in the art may use different structural components than those in the preferred embodiment to produce the method of operation of FIGS. 7A–7D.

At step 550, a user begins filling a NGV by pressing a start button at step 570 in the remote input 220. The pressure meter 430 checks the pressure at step 580 in the second manifold gas line 480 to determine if the pressure is less than the necessary 3000 psi. The standard pressure for CNG tanks in NGVs is 3000 psi; of course, the method described herein is applicable to other pressures. The pressure information is sent to the mass flow meter 240 by meter lines 263–265 and then to the PLC 260 through flow line 266. If the PLC 260 is sent information that the pressure in the second manifold gas line 480 is not less than 3000 psi, the manifold outlet 440 is opened, at step 585, the NGV filled with CNG, and the dispensing ends at step 600. However, if the PLC 260 is sent information that the pressure in the second manifold gas line 480 is less than 3000 psi, PLC 260 opens the first gas solenoid valve 370 at step 590 to dispense gas to the NGV. The gas is dispensed through the first gas solenoid valve 370 from the first storage vessel 171 until a predetermined delivery condition, either no flow of gas at step 601 or a low flow of gas at step 610, is reached. Alternatively, gas may be dispensed for a fixed time. The fixed time may be invariant or may vary based on the CNG pressure in the storage vessels 171–175. When the predetermined condition is reached, the second gas solenoid valve 380 opens at step 620. Gas is then dispensed through the second gas solenoid valve 380 from the second storage vessel 172 until there is no flow of gas at step 630 or a low flow of gas at step 640 is reached. When either situation occurs, the third gas solenoid valve 390 opens at step 650. Gas is then dispensed through the third gas solenoid valve 390 from the third storage vessel 173 until there is no flow of gas at step 660 or a low flow of gas is reached at step 670. Again, when either situation occurs, the fourth gas solenoid valve 400 opens at step 680. Gas is then dispensed through the fourth gas solenoid valve 400 from the fourth storage vessel 174 until there is no flow of gas at step 690 or a low flow of gas at step 700 is reached. When either situation occurs, the fifth gas solenoid valve 410 opens at step 710. Gas is then dispensed through the fifth gas solenoid valve 410 from the fifth storage vessel 175. After the fifth gas solenoid valve 410 opens at step 710, the booster solenoid valve 340 opens at step 720 to begin the gas booster pump 330. The pressure of the gas from the fifth gas solenoid valve 410 is raised to the desired 3000 psi pressure and dispensed into the NGV. The gas booster pump 330 continues pumping until the pressure in the NGV is 3000 psi at step 740, at which time the dispensing ends at step 600.

As each NGV is being filled, the pressure of the CNG stored in the storage vessels 171–175 lowers from a typical pressure of 2400 psi. Although the typical pressure in storage vessels 171–175 starts at 2400 psi, higher pressures may be used. Thus, after numerous NGV fills, the flow from each storage vessel 171–175 through the respective gas solenoid valve 370, 380, 390, 400, 410 will be low or there may be no flow at all. In order to maintain a high pressure in the fifth storage vessel 175 so that the NGV fill times remain fast and more stored gas in storage vessels 171–175 is utilized, fifth storage vessel 175 is backfilled to a pressure of 2400 psi from the remaining gas in the four other storage vessels 171–174.

To start the backfill procedure, the user turns a key at step 750 in the remote input 220. At step 760, the natural gas hose pressure sensor 530 checks the pressure in the natural gas hose 183 to determine if the pressure is less than 2400 psi. If the pressure is not less than 2400 psi, there is no need to backfill the fifth storage vessel and the backfilling process ends at step 770. However, if the pressure in the natural gas hose 183 is less than 2400 psi, the gas booster pump inlet 450 and the booster solenoid valve 340 open at step 771. At step 780, the user selects to backfill the fifth storage vessel 175 by pressing the necessary button at step 790 in the remote input 220 which opens the first gas solenoid valve 370 at step 800. Gas remaining in the first storage vessel 171 is transferred to the fifth storage vessel 175 through the gas booster pump 330 in order to raise the pressure of the fifth storage vessel 175. At step 815, the user decides whether to select the next storage vessel for backfilling the fifth storage vessel 175. If the user chooses to backfill the fifth storage vessel 175 from the next storage vessel, the user presses at step 810 the remote input 220. The first gas solenoid valve 370 then closes and the second gas solenoid valve 380 opens at step 820. Gas remaining in the second storage vessel 172 is transferred to the fifth storage vessel 175 through the gas booster pump 330 in order to raise the pressure of the fifth storage vessel 175. However, if the next storage vessel is not selected, the user may wait for the necessary pressure in the fifth storage vessel 175 to reach 2400 psi at step 880 and then end the backfilling process at step 770. If the third storage vessel 173 is selected at step 825 to backfill the fifth storage vessel 175, the user presses at step 830 the remote input 220 to close the second gas solenoid valve 380 and open the third gas solenoid valve 390 at step 840. Gas remaining in the third storage vessel 173 is transferred to the fifth storage vessel 175 through the gas booster pump 330 in order to raise the pressure of the fifth storage vessel 175. However, if the third storage vessel 173 is not selected, the user may wait for the necessary pressure in the fifth storage vessel 175 to reach 2400 psi at step 880 and then end the backfilling process at step 770. If the fourth storage vessel 174 is selected at step 845 to backfill the fifth storage vessel 175, the user presses at step 850 the remote input 220 and the third gas solenoid valve 390 closes while the fourth gas solenoid valve 400 opens at step 860. Gas remaining in the fourth storage vessel 174 is transferred to the fifth storage vessel 175 through the gas booster pump 330 in order to raise the pressure of the fifth storage vessel 175. However, if the fourth storage vessel 174 is not selected, the user may wait for the necessary pressure in storage vessel 175 to reach 2400 psi at step 880 and then end the backfilling process at step 770. At this point, the user may stop the backfilling process by pressing the remote input 220 at step 870 to close all open valves 890 and end the backfilling process at step 770. Otherwise, the user may wait at step 880 until the pressure in the fifth storage vessel 175 reaches 2400 psi to close all open valves at step 890 and end the backfilling process at step 770.

I claim:

1. A method of dispensing compressed gas contained in n storage vessels, comprising the steps of:

(a) sequentially dispensing compressed gas from storage vessels 1 to n until predetermined delivery conditions are reached for each storage vessel;

(b) repeating said step (a) until the gas in storage vessel n reaches a predetermined delivery condition;

(c) backfilling storage vessel n using compressed gas from storage vessels 1 to n−1;

(d) repeating said step (a) after said step (c).

2. A method of dispensing compressed gas according to claim 1, further comprising (e) repeating said step (a) after said step (d).

3. A method of dispensing compressed gas according to claim 1, wherein said step (c) comprises backfilling storage vessel n by pumping gas from storage vessels 1 to n−1 into storage vessel n.

4. A method of dispensing compressed gas according to claim 1, wherein said step (a) comprises dispensing compressed gas from each of the n storage vessels for a specified time.

5. A method of dispensing compressed gas according to claim 1, wherein said step (a) comprises dispensing compressed gas from each of the n storage vessels until a predetermined transfer flow is reached.

6. A method of dispensing compressed gas according to claim 1, wherein said step (a) comprises dispensing compressed gas from each of the n storage vessels until there is no flow of gas from the respective storage vessel.

7. A method of dispensing compressed gas according to claim 1, wherein said step (b) comprises repeating said step (a) until the gas dispensed from storage vessel n reaches a predetermined transfer flow.

8. A method of dispensing compressed gas according to claim 1, wherein said step (b) comprises repeating said step (a) until there is no flow of gas from storage vessel n.

9. A method of transferring compressed gas from n storage vessels to a container, comprising the steps of:

(a) sequentially transferring compressed gas from respective ones of storage vessels 1 to n to the container until predetermined delivery conditions are reached for the respective storage vessels;

(b) detecting the pressure of the gas transferred to the container from storage vessel n;

(c) boosting the pressure of the compressed gas transferred to the container from storage vessel n if the pressure detected in said step (b) is less than a predetermined container pressure;

(d) repeating said steps (a), (b) and (c) until the gas in storage vessel n reaches a predetermined delivery condition;

(e) backfilling storage vessel n with compressed gas from storage vessels 1 to n−1;

(f) repeating said steps (a), (b) and (c) after said step (e).

10. A method of transferring compressed gas from n storage vessels to a container according to claim 9, wherein said step (c) comprises boosting the pressure of the compressed gas dispensed from storage vessel n to at least 3000 psi.

11. A method of transferring compressed gas from n storage vessels to a container according to claim 9, wherein said step (a) comprises sequentially dispensing compressed gas from storage vessels 1 to n until there is a predetermined flow of gas from the respective storage vessel.

12. A method of transferring compressed gas from n storage vessels to a container according to claim 9, wherein said step (d) comprises repeating said steps (a), (b), and (c) until the gas transferred from storage vessel n reaches a predetermined transfer flow.

13. A method of transferring compressed gas from n storage vessels to a container according to claim 9, wherein said step (d) comprises repeating said steps (a), (b), and (c) until there is no flow of gas from storage vessel n.

14. An apparatus for dispensing compressed gas, comprising:

n storage vessels;

a booster pump having an inlet and outlet;

a manifold system connected to said n storage vessels and said booster pump inlet and outlet, said manifold system having an outlet, said manifold system being arranged to selectively transfer compressed gas between respective ones of said n storage vessels and said manifold outlet, to transfer gas between storage vessels 1 to n−1 and storage vessel n, to transfer gas between respective ones of said n storage vessels and said booster pump inlet, to transfer gas between said booster pump outlet and said manifold outlet, and to transfer gas between said booster pump outlet and said storage vessel n;

a control system to operate said manifold system to sequentially dispense gas at said manifold outlet from respective ones of said n storage vessels, and to backfill storage vessel n using said booster pump to transfer gas to storage vessel n from said storage vessels 1 to n−1.

15. An apparatus according to claim 14, wherein $n>3$.

16. An apparatus according to claim 14, wherein $n\leqq 6$.

17. An apparatus according to claim 14, wherein each of said storage vessels comprises a plurality of connecting tubes.

18. An apparatus according to claim 14, wherein said control system comprises a mass flow computer and a programmable logic controller responsive to said mass flow computer.

19. An apparatus for dispensing compressed gas, comprising:

n storage vessels;

a booster pump having an inlet and outlet;

n control valves associated with respective ones of said n storage vessels;

a check valve having an inlet and outlet;

a first manifold interconnecting said n control valves and said inlet of said booster pump and said inlet of said check valve for gas flow;

a second manifold interconnecting said outlet of said booster pump and said outlet of said check valve for gas flow, said second manifold having a manifold gas outlet;

a third manifold interconnecting said second manifold and said control valve associated with said storage vessel n for gas flow;

a control system to operate said n control valves and said booster pump to (a) sequentially connect storage vessels 1 to n to said manifold gas outlet, (b) to selectively connect storage vessel n to said booster pump inlet, and (c) to connect said outlet of said booster pump to storage vessel n.

20. An apparatus for dispensing compressed gas, comprising:

n storage vessels;

a booster pump having an inlet and outlet;

a manifold system adapted to transfer compressed gas between respective ones of said n storage vessels, and to transfer compressed gas between said n storage vessels and said booster pump, said manifold system having an outlet;

first means for connecting said n storage vessels, said booster pump inlet, and said booster pump outlet to said manifold system;

second means for monitoring gas flow at said outlet of said manifold;

third means responsive to said second means, for controlling said first means to sequentially dispense compressed gas from storage vessels 1 to n until predetermined delivery conditions are reached for each storage vessel, and to backfill storage vessel n using compressed gas from storage vessels 1 to n−1.

* * * * *